United States Patent [19]

Zocher

[11] 4,035,881

[45] July 19, 1977

[54] METHOD AND APPARATUS FOR PRODUCING NON-WOVEN TEXTILE PRODUCT

[76] Inventor: Josef Zocher, Kreuzstrasse 26, 51 Aachen, Germany

[21] Appl. No.: 557,186

[22] Filed: Mar. 10, 1975

[30] Foreign Application Priority Data

Mar. 12, 1974 Germany ..... 2411685

[51] Int. Cl.[2] ..... D04H 18/00

[52] U.S. Cl. ..... 28/111; 28/112; 28/115

[58] Field of Search ..... 28/4 R, 4 N, 72.2 R; 428/85, 218; 156/72

[56] References Cited

U.S. PATENT DOCUMENTS

| | | | |
|---|---|---|---|
| 2,377,564 | 6/1945 | Lundgren | 28/4 R |
| 3,022,813 | 2/1962 | Glover | 28/4 R |
| 3,397,436 | 8/1968 | Zocher | 28/4 R |
| 3,506,530 | 4/1970 | Crosby | 28/72.2 R |
| 3,613,190 | 10/1971 | Crosby | 28/4 R |
| 3,729,785 | 5/1973 | Sommer | 28/4 R |
| 3,925,866 | 12/1975 | Lochner | 28/4 R |
| 3,935,046 | 1/1976 | Kiernan | 28/72.2 R |
| 3,940,532 | 2/1976 | Smith | 28/72.2 R |

FOREIGN PATENT DOCUMENTS

| | | | |
|---|---|---|---|
| 672,606 | 5/1952 | United Kingdom | 28/4 R |

*Primary Examiner*—Louis K. Rimrodt
*Attorney, Agent, or Firm*—Michael J. Striker

[57] ABSTRACT

A non-woven textile fabric having a non-woven central web and tufts projecting from opposite faces of the web is produced by pushing through the central web simultaneously and from opposite sides thereof a plurality of needles constructed to displace strands of the web beyond opposite faces thereof.

12 Claims, 9 Drawing Figures

SN
PN1
PN2
1
1'
2
3
4
5
6
7
9
9'
9''
10
11
12
16
17
18
19
20
21
21'
22
23
24
25
26
27
28

19
20

METHOD AND APPARATUS FOR PRODUCING NON-WOVEN TEXTILE PRODUCT

BACKGROUND OF THE INVENTION

The present invention relates to a method and apparatus for producing a non-woven tufted textile fabric in which a web comprising at least one layer of fibers or small bands is pierced through by a plurality of felt needles and in subsequently thereto by needles having prongs or hooks at the ends thereof to form a nap of loops or tufts on opposite faces of the web.

It is known to manufacture a non-woven textile fabric in which a loop-like of tuft-like structure is produced on one of the two faces of the web. In order to produce such a textile fabric the non-woven web is pierced in a known needle machine with felt needles whereby hooks provided on the shaft of the felt needles will grip fibers of the felt to reorientate the fibers from a substantially horizontal to a substantially vertical position which will result in a compacting of the web with increasing strength thereof. The piercing of the web is repeated several times (60–180 punctures per centimeter square) and such piercing is alternately produced from opposite faces of the web. Thereby small fiber tufts produced at the outlet ends of the punctures are, during transport of the web through the machine, to a major part again bent back into the web. Subsequently thereto the web is subjected to a structuring on a machine as for instance disclosed in U.S. Pat. No. 3,729,785 in which the web is punctured or pierced by loop or fork needles which on their free ends have a fork-shaped configuration or which closely adjacent to their pointed ends have hooks for gripping and transporting a desired amount of fibers during each puncturing. Such needles will grip considerably greater fiber tufts or loops as is possible with felt needles and the needles of the last-mentioned machine will push these tufts or loops out from the web so that each needle will form a fiber tuft of a length up to 20 millimeters. In order to prevent that the loops or tufts formed by the needles are again destroyed during forming of the following loops or tufts, there are arranged in each needle holder plate of the machine a plurality of needles spaced in the direction of the transporting of the web through distances corresponding to the advancing steps of the web so that several needles will penetrate one after the other in each of the loops or tufts. The forces imparted to the needles during this operation add up to considerable forces in the order of several tons. These forces are taken up by a base plate on which the web abuts. The web is held during withdrawing of the needles by a stripper plate provided with openings for the puncturing needles. To prevent damage or destruction of the tufts produced, the base plate is provided with slots extending in the direction in which the web is transported, in which the tufts during the transport of the web are moved freely dependent from the web. Thus on one side of the web a velour or rib-shaped surface structure is produced. The opposite face of the web is mechanically compacted and is usually additionally chemically treated, for instance by applying a layer of latex thereon, whereby the web is strengthened while this opposite face thereof looses its textile character. Such products may be used as lining material, floor covering or for similar purposes in which only the structured surface is visible. Attempts to provide a textile fabric of the aformentioned kind in which also the second face of the web is provided with tufts, have failed due to the fact that during puncturing the web from the already structured face, in order to transport fiber material also beyond the opposite face, the first produced fiber tufts or loops have been again destroyed. For purposes in which it is necessary to provide opposite faces with the mentioned textile structure, for instance for blankets, two webs, each provided only on one side with a structured nap, have been connected at the nonstructured sides to each other. Such a method is not only relatively expensive, but it results also in relatively stiff products which have found only limited use in the trade.

SUMMARY OF THE INVENTION

It is an object of the present invention to provide a method and apparatus for producing a mechanically prefirmed non-woven fabric which is provided at opposite faces with a nap having closely adjacent loops or tufts of fibers, which has a low specific weight per square unit and the largest possible volume and in which the volume and the strength characteristics of the thus-produced textile fabric are adapted for many different purposes.

It is a further object of the present invention to provide a method and apparatus of the aforementioned kind in which the mentioned textile fabric may be produced in a very efficient manner.

It is an additional object of the present invention to provide an apparatus for producing a fabric of the above mentioned type which is composed of relatively few and simple parts so that the apparatus may be manufactured at reasonable cost and will stand up properly under extended use.

With these and other objects in view, which will become apparent as the description proceeds, the method according to the present invention for producing a non-woven textile web having loops or tufts of textile strands or fibers projecting from opposite faces thereof mainly comprises the steps of pushing into a non-woven web of textile material simultaneously and from opposite sides a plurality of needles spaced in longitudinal and transverse direction of the web from each other and constructed to displace strands of the web out of the plane of the latter, in which the needles to one side of the web are arranged substantially symmetrically between the needles on the other side, to thus form tufts of textile strands or fibers projecting to opposite sides of the web. Subsequently thereto the web is moved in longitudinal direction at least through a distance approximately equal to a fraction of the longitudinal spacing of the needles on one side of the web or through a distance equal to an integral number of such spacing, and the needles are pushed again simultaneously and from opposite sides into the web so that at least some of the needles will penetrate into the web at locations closely adjacent to the penetration of the needles during the preceding pushing step so as to strengthen the reorientation of the strands in pushing direction of the needles produced during the preceding step and to increase the tufts by reorienting additional strands of the web.

In the method according to the present invention the groups of fibers engaged by the individual needles are simultaneously and in opposite direction displaced and on both faces of the web under additional firming of the same pushed out of the web so that formation of tufts on one face of the web is not detrimentally affected by the simultaneous forming of tufts on the opposite face. In such a process the forces produced on opposite sides of the web will counteract each other substantially. In accordance with the method of the present invention it is possible to use pre-compacted webs of chemically produced fibers, for instance fibers of plastic material as well as all other fiber material suitable for known needling processes, whereby it is possible to use a preponderant amount of the fiber weight for the formation of tufts on opposite faces of the web, that is to produce a product with a so-far not obtainable volume with a very small weight per unit area.

An especially shape-retaining product which can be used for many purposes can be obtained when according to the present invention the web is formed by two pre-needled layers of fibers or small bands between which a binder layer is arranged which subsequent to the needling step for forming tufts on opposite sides of the web, is activated thermally or chemically to stabilize the fabric structure produced. It is especially advantageous when a foil of meltable material with an essentially lower melting point than that of the fibers or small bands from which the two layers are formed is sandwiched between the two layers and the thus superimposed layers and foil therebetween are pre-needled with about 60 to 200 punctures per square centimeter whereby subsequently thereto the additional needling for forming the tufts is carried out and finally the thus-formed structure is subjected to heat to melt the foil. Meltable foils formed from copolyamides with a melting point of 95° to 170° C are especially suitable for this purpose, which may be used without detrimentally affecting the material of the fibers in the two layers and without affecting the formation of the above-mentioned structure whereby for the fibers of the two layers PA 6.6 Nylon (melting point 250° C), PA 6.Perlong (melting point 215° C) or PES Terylene (melting point 256° C) may be used.

The molten foil will additionally permanently glue the ends of the fibers displaced from one of the layers into the other layer to the remaining base layer of the fabric. The provision of a meltable foil between layers of fibers is known in a non-woven web which is produced in known felt needle machines in which at least one layer of loosely connected fibers is used and in which the displaced fibers are after melting of the foil held together by being glued together by the molten foil material.

Instead of a meltable foil between the two layers of fiber material it is also possible to provide a net-shaped structure with a low melting point between the two layers. It is also possible to use as reinforcement between the two layers of fiber material a net of plastic wires with a very high melting point or metal wires to produce a material which can be subjected to very high tensile stresses.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
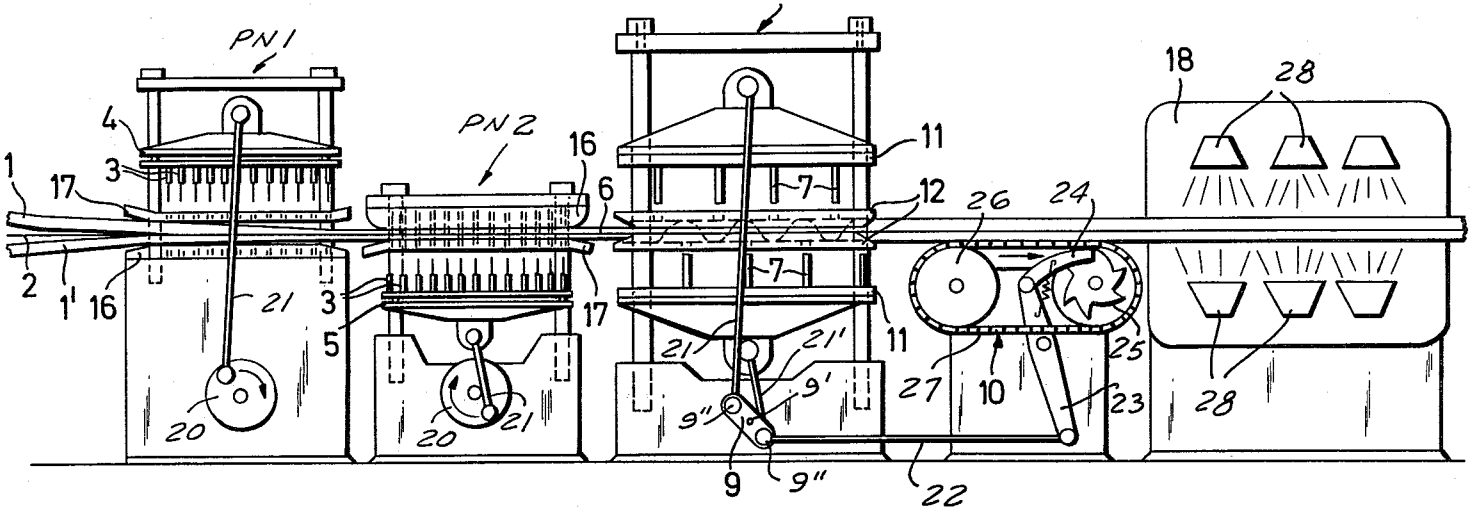
FIG. 1 is a schematic side view of an arrangement for producing a non-woven textile material of the above-described structure according to the present invention.
Figure 2:
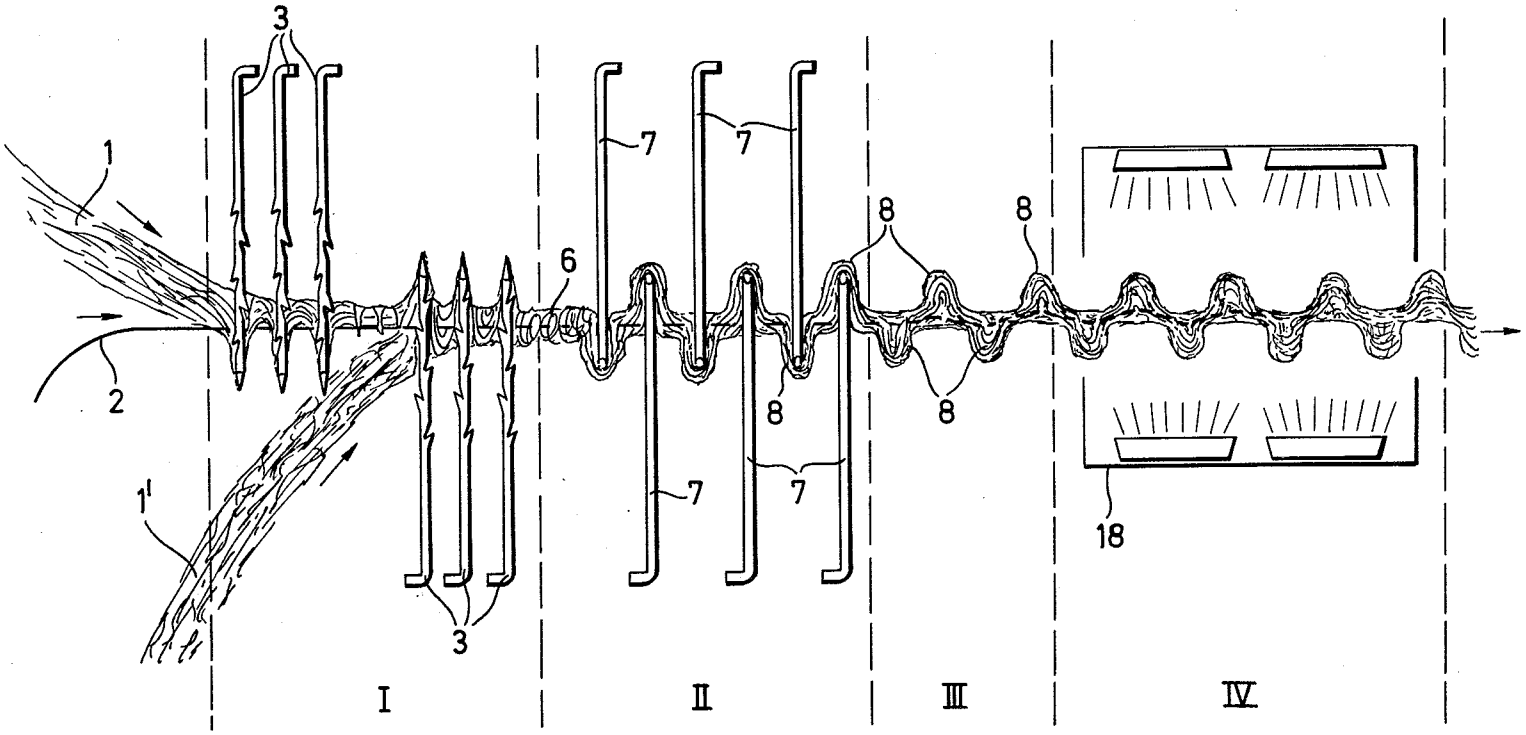
FIG. 2 is a schematic illustration of the method according to the present invention.

Referring now to the drawing, and more specifically to FIGS. 1 and 2 of the same, it will be seen that the apparatus according to the present invention comprises, as schematically illustrated in FIG. 1, a first pre-needling unit PN1, a second pre-needling unit PN2 downstream of the first unit and an additional needling unit SN located downstream of the second pre-needling unit. Web means composed of two non-woven webs or layers of fibers or small bands 1 and 1' with a thin layer of binder material 2 sandwiched therebetween are stepwise transported in longitudinal direction through the three units by transporting means 10 located downstream of the unit SN. A chamber 18 is arranged downstream of the transporting means 10 through which the web means is passed for a purpose as will be described later on.

The first pre-needling unit PN1 comprises a stationary base plate 16 arranged to engage the bottom face of the web 1' and, upwardly spaced from the base plate 16, a stationary stripper plate 17 arranged to engage the top face of the web 1. Arranged above the stripper plate 17 is a needle holder plate 4 which carries a plurality of felt needles of a construction as best shown in FIG. 2. The needle holder plate 4 is mounted for reciprocating movement on vertical rods, in the manner as illustrated schematically in FIG. 1, and reciprocated in vertical direction by a crank drive 20 continuously rotated for instance in clockwise direction, as indicated by the arrow, and connected by a connecting rod 21 to the needle holder plate 4. The base plate 16 and the stripper plate 17 are provided with a plurality of openings through which the felt needles 3 may penetrate during reciprocation of the needle plate 4 in vertical direction.

The second pre-needling unit PN2 is constructed similar to the first pre-needling unit, but differs therefrom in that the stripper plate 17 is arranged to engage the bottom face of the web 1', whereas the plate 16 is arranged to engage the top face of the web 1. The needle holder plate 5 carrying the felt needles 3 is in this case arranged beneath the stripper plate 17 and reciprocated in vertical direction by a crank drive 20 and a connecting rod 21 between the crank drive and the needle holder plate 5. The web means 6 leaving the second pre-needling unit is passed between two stationarily arranged guide or stripper plates 12 of the needling unit SN, and this unit includes further a pair of reciprocatable needle holder plates 11 guided for reciprocation on vertical standards and carrying structuring needles 7 of a configuration as best shown in FIG. 2, in which the free ends of the needles are prong-shaped. The needles 7 carried by the upper needle holder plate 11 are spaced from each other in the direction of advance of the web means 6 and also in a direction transverse thereto, whereas the needles 7 on the lower needle holder plate 11 are arranged between and symmetrically with respect to the needle 7 on the upper needle holder plate 11. The upper and the lower needle holder plates 11 are reciprocated simultaneously and respectively in opposite directions by a crank drive including a double-arm crank lever 9, turned by a motor not shown, about an axis 9' and the two crank pins 9'' respectively arranged in the region of opposite ends of the crank arm 9 are again connected by connecting rods 21 and 21' to the upper and lower needle plates 11, respectively. The position of at least one of the crank pins 9'', or, preferably, the position of both crank pins, may be adjusted toward and away from the pivot axis 9' of the crank lever 9 in a manner well known in the art. For instance, the crank arm 9 may be provided with two slots extending in longitudinal direction of the crank arm away from the pivot axis in each of which a non-rotatable portion of the respective crank pin is guided and in which the non-rotatable portion of the crank pin is provided with an internal screw thread in which a threaded spindle mounted in the arm 9 rotatable, but not shiftable in axial direction, is engaged so that during turning of the spindle the position of the respective crank pin relative to the pivot axis 9' may be changed, to change thereby the stroke at which the respective needle holder plate is reciprocated.

The transporting means 10 arranged downstream of unit SN comprises two rolls 26 and 26' spaced in the direction in which the web means emanating from the unit SN has to be transported and each turnable about a horizontal axis. An endless flexible band 27, which may be composed of interconnected links, is mounted about the rolls 26 and 26' so that the upper run of the band 27 engages the bottom face of the web means emanating from the unit SN. The band 27 is stepwise moved by a pawl and ratchet mechanism including a ratchet wheel 25 fixed to the roll 26' for rotation therewith and a pawl 24 adapted to engage the teeth of a ratchet wheel 25 and moved to and fro by a double-armed lever 23 connected at its lower end by a connecting rod 22 for instance to one of the crank pins 9'' on the crank lever 9 of the unit SN. This arrangement is made in such a manner that during each revolution of the crank arm 9 of the unit SN the band 27 is moved for a distance equal to a fraction of the spacing between the needles 7 in the direction of transporting of the web means, or to an even multiple of such spacing, and in such a manner that transporting of the web means emanating from the unit SN will occur when the needles 7 of this unit are withdrawn from the webs passing between the stripper plates 12.

A chamber 18 is arranged downstream of the transporting means 10 through which the web means is guided by the transporting means or by additional withdrawing means, not shown in the drawing, and arranged downstream of the chamber 18. A plurality of devices 28 are arranged in the chamber 18 to opposite sides of the web means passing therethrough and the devices 28 are either heating units or units for spraying a chemical against opposite faces of the web means.

Figure 3:
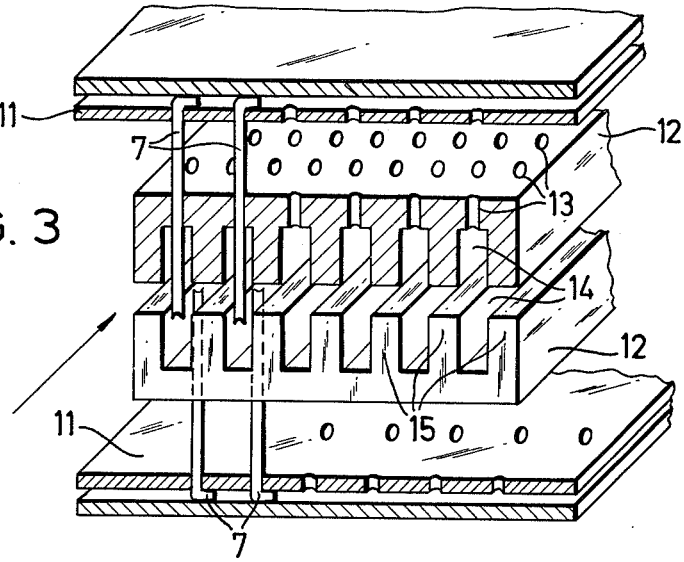
FIG. 3 is an enlarged perspective partially sectioned view of part of the arrangement shown in FIG. 1.
Figure 5:
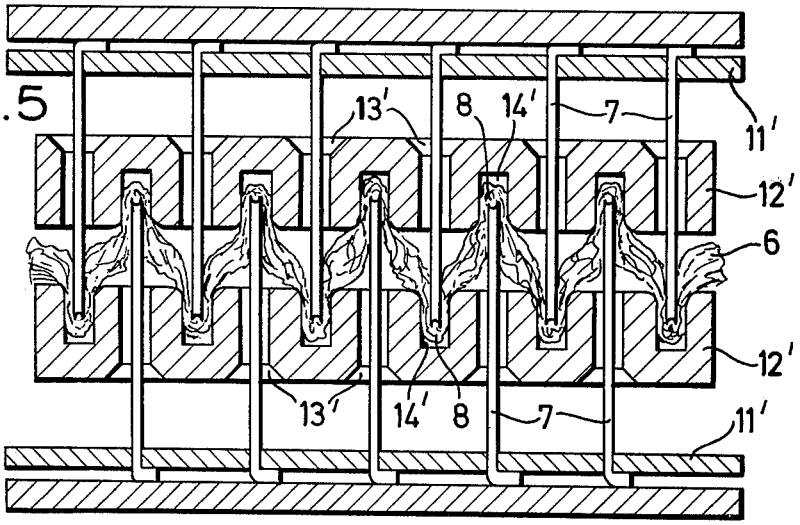
FIG. 5 is a sectional view similar to FIG. 3 with a different arrangement of the needles and corresponding different arrangement of the guide plate for the needles.
Figure 6:
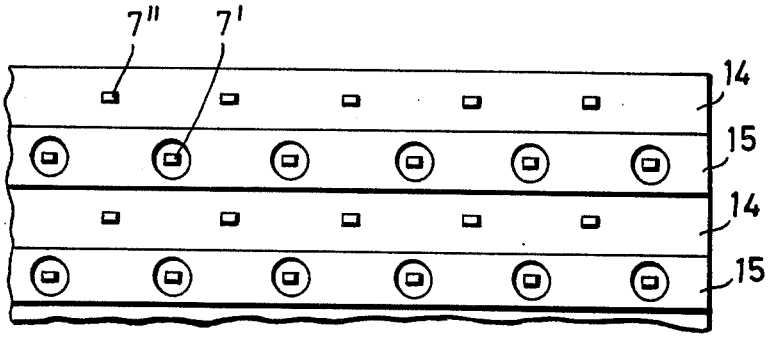
FIGS. 6 and 7 are top views of portions of the apparatus respectively shown in FIGS. 3 and 5.
Figure 4:
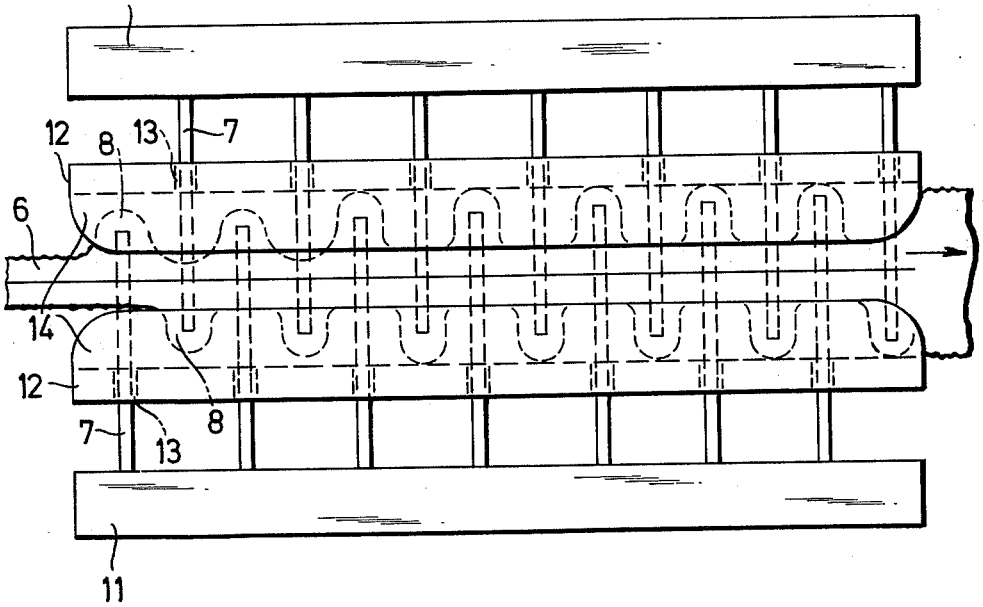
FIG. 4 is a side view of the portion of the apparatus shown in FIG. 3.
Figure 7:
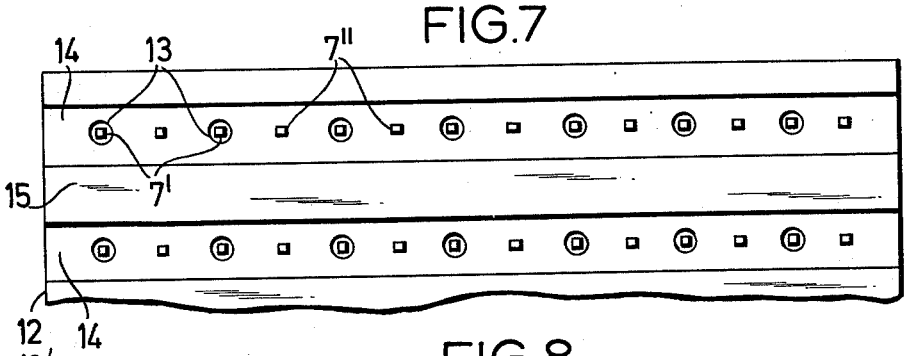
Figure 8:
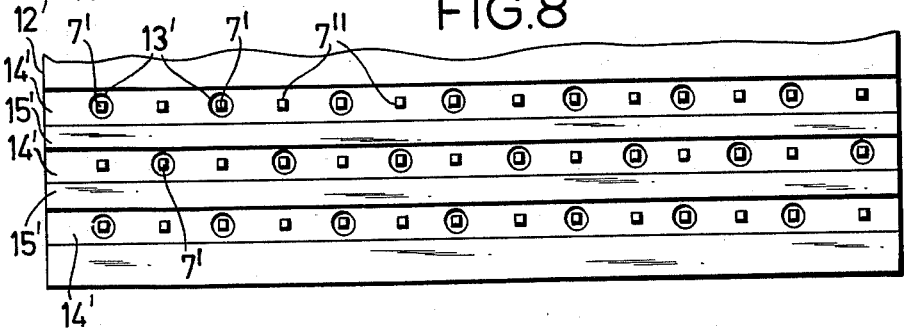
FIG. 8 is a modification of the apparatus shown in FIGS. 6 and 7

FIGS. 3, 4 and 6 more specifically illustrate the construction of the guide or stripper plates 12 and the needles 7 passing therethrough. FIGS. 5, 7 and 8 show a slight modification of the arrangement shown in FIGS. 3, 4 and 6. Each of the plates 12, respectively 12', is formed with a plurality of openings 13, respectively 13', for the passage of the needles 7 therethrough, and each of these plates is provided with a plurality of substantially straight grooves 14, respectively 14', which extend, from the surface of the plate facing the web means 6, into the respective plate and these grooves extend substantially in the direction in which the web means 6 is stepwise transported. The grooves 14, respectively 14', are defined between ribs 15, respectively 15', which extend in the aforementioned direction. The tufts 8 which are displaced by the respective needles 7 will therefore extend upstanding or hanging into the aforementioned grooves 14 or 14' during the movement of the web means in longitudinal direction so that they are protected against damage during such movement. The configuration of the produced textile structure will depend essentially on the distribution of the needles 7 in the needle holder plates 11. The needle holder plates 11 and the guide or stripper plates 12 coordinated therewith may be exchanged according to the present invention against different plates and also be provided with needles of different gripping ability so that in this way it is possible to produce with the apparatus according to the present invention many variations in the finished product.

FIGS. 6 and 7 respectively illustrate different needle distributions for the plates 12 and 12', respectively shown in FIGS. 3 and 5. FIGS. 6 and 7 are cross-sections taken substantially in the plane at which the web means is passed between the plates 12, respectively 12'. The plates 12, respectively 12', shown in FIGS. 6 and 7 are top views of the lower plates 12 or 12' shown in FIGS. 3 and 5. The needles which pass through the openings 13, respectively 13', in these plates are referred to with the reference numeral 7', whereas the needles extending downwardly through the upper plate are referred to with the reference numerals 7''. As shown in FIGS. 6 and 7 these needles are arranged in rows respectively aligned with the grooves 14, respectively 14', in these plates which are respectively separated by ribs 15, respectively 15'. The needle distribution shown in FIG. 6 will produce a rib-like structure of tufts on the finished product, whereas the needle distribution shown in FIG. 7 will produce a velour-like structure. Evidently, by different distribution of the needles, different surface structures may be obtained on the finished product.

An additional possibility to vary the surface structure of the final product is to adjust the stroke of the needle holder plates 11, in the manner as described before, so that longer or shorter tufts may be produced or that the tufts projecting from one face of the central web are longer than the tufts projecting from the other face thereof.

The above-described arrangement will operate as follows:

As shown in FIGS. 1 and 2, two layers or webs 1 and 11 of a non-woven fabric consisting of fibers or small bands are superimposed upon each other with a layer of binder material 2, which may for instance consist of a meltable plastic, sandwiched therebetween is guided first through the units PN1 and PN2 in which the material is subjected to a needling operation with felt needles 3, whereby the two webs 1 and 1' are united and firmed or compacted. The resulting web means 6 is then passed through the structuring needle apparatus SN in which it is subjected to the action of the needles 7 which penetrate simultaneously from opposite sides and in opposite directions through the web means 6 to form tufts or loops 8 projecting from opposite sides of a central web portion. The tufts 8 thus produced will extend, as mentioned before, into the grooves 14 or 14' of the guide or stripper plates 12, respectively 12', so that during tranportion of the web means in longitudinal direction, these tufts will not be damaged. The transporting means 10 transport the web means 6 stepwise and in such a manner that the needles 7 during the repeated reciprocation will penetrate into the web means 6 substantially in the region of the tufts produced during the first engagement of the web means by the needles 7 so that the tufts 8 will be enlarged and compacted. During penetration of the needles 7 from one side into the web means, the opposite side or face of the web means will be supported on the faces of the ribs 15, respectively 15', of the respective guide or stripper plate 12, respectively 12', which thus prevents a local distortion of the web means, whereas during withdrawal of the needles 7 from the web means the plate 12, respectively 12', through which the needles are withdrawn, will act as a stripper plate. Even though the puncturing forces of the needles 7, due to the greater mass of fibers displaced thereby is a multiple of the forces acting on the felt needles 3, a trouble-free operation with relatively lightly constructed guide or stripper plates is assured, since due to the simultaneous movement of the needles in opposite directions and from opposite sides of the web an equalization of the oppositely directed forces is obtained and the oppositely operating needles will provide also a supporting function so that the forces which have to be taken up by the plates 12, respectively 12', are essentialy smaller than the forces which have to be taken up by the plates 16 of the pre-needling units.

The web means provided with the tufts 8 is then in the region IV shown in FIG. 2 guided through a chamber 18 in which, for instance, a plurality of heating units 28 are arranged on opposite sides of the web means passing therethrough to heat the web means to a temperature in which the foil 2 will melt so that the ends of the fibers which are drawn out of the plane of the web means are glued to the central layer thereof, without however changing the fibers which have a melting point considerably higher than the foil 2. A withdrawal device of known construction and not shown in the drawing is preferably arranged downstream of the chamber 18.

If instead of a meltable foil, a chemical activatable binder layer is sandwiched between the two webs 1 and 1', then a plurality of units is arranged in the chamber 18, instead of the heating units 28, to spray onto the web means passing therethrough liquid or gaseous chemicals which activated the binder layer. The cementing or gluing will not only prevent that individual fibers of the tuft structure will become separated from the base layer of the product but it will also assure an increased form stability of the base layer, that is the base layer or central layer will properly withstand tensile stresses in any direction so that the product produced will have, even without reinforcements provided therein a very high tensile strength.

Figure 9:
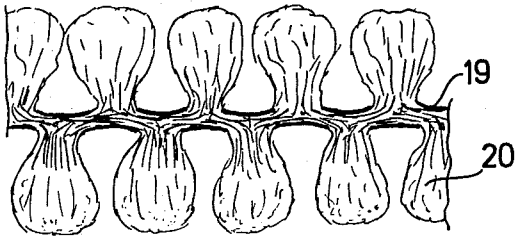
FIG. 9 is a cross-sectional view of the product produced according to the method and apparatus of the present invention.

FIG. 9 illustrates at an enlarged scale a side view of the product produced according to the present invention in which the firmed base layer 19 has approximately 30 to 40% and the loose tuft structure 20 projecting from opposite faces of the base layer has about 60 to 70% of the total weight of the structure and wherein the height of the tufts is a multiple of the thickness of the base layer.

Since the product according to the present invention has a very large volume and a small specific weight of 500 grams per square meter or less, the product according to the present invention can be advantageously used for many purposes, for instance for sleeping or travel blankets, for an intermediate layer in garments, for a garment material for protection against extremely low temperature, and for industrial purposes as for instance heat insulation, filter material and material for sound proofing.

For the first-mentioned purposes non-woven textiles produced according to the present invention are especially suitable in which the tufts projecting from the base layer of the fabric are arranged in rib-like rows, or arranged in groups to form a special pattern, in which the tufts projecting from opposite sides of the base layer have respectively different lengths, and such fabrics which are formed from two layers of fibers of different colors. In the last-mentioned type of fabric a new color effect may be obtained since the fibers which are displaced in form of tufts by the needles 7 through the base layer will have different colors than the respective face of the base layer. For instance if the two webs 1 and 1' which are fed into the apparatus have respectively yellow and red colors, then the needles 7 will transport yellow fibers beyond the red face of the base layer and vice versa so that the rib structure on the red face of the base layer will have a yellow color and the rib structure on the yellow face of the base layer will have a red color.

It will be understood that each of the elements described above, or two or more together, may also find a useful application in other types of method and apparatus for producing a non-woven textile fabric having loops or tufts of textile strands projecting from opposite faces thereof differing from the types described above.

While the invention has been illustrated and described as embodied in a method and apparatus for producing a nonwoven textile fabric having loops or tufts of textile strands projecting from opposite faces thereof, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set set forth in the appended claims.

1. A method for producing a non-woven textile material having loops or tufts of textile strands projecting from opposite faces thereof, comprising the steps of subjecting a non-woven web means of textile material from opposite sides to a preneedling operation to strengthen and compact said web means; subsequently pushing into said preneedled web means simultaneously and from opposite sides a plurality of needles spaced in longitudinal and transverse direction of said web means from each other and constructed to displace strands of the web means during the pushing of the needles through said web means, with the needles to one side of the web means arranged substantially symmetrically between the needles on the other side, to thus form tufts of textile strands projecting to opposite sides of said web means; subsequently moving the web means in longitudinal direction at least through a distance equal to a fraction of the longitudinal spacing of the needles on one side of said web means; thereafter pushing said needles again simultaneously and from opposite sides through said web means so that at least the majority of the needles will penetrate into said web means at locations closely adjacent to the penetration of the needles during said preceding pushing step so as to strengthen the reorientation of the strands in pushing direction of the needles produced during the preceding pushing step and to increase the tufts by reorienting additional strands of the web means to a height which is a multiple of the thickness of the remaining central web; and repeating the above steps over the whole length of said web means.

2. A method as defined in claim 1, wherein said web means is moved after each pushing step through a distance approximately equal to the longitudinal spacing of the needles on one side of the web means.

3. A method as defined in claim 1, wherein said web means is moved after each pushing step through a distance approximately equal to an integral multiple of the longitudinal spacing of the needles on one side of said web means.

4. A method as defined in claim 1, wherein said plurality of needles on one side of said web means is pushed through the latter for a distance different from that of the plurality of needles on the other side of the web means.

5. A method as defined in claim 1, and including the step of supporting said web means intermediate said needles during the pushing steps.

6. Apparatus for producing a non-woven textile fabric having tufts or strands projecting from opposite faces thereof, comprising, in combination, means for transporting a web means of non-woven textile material stepwise along substantially rectilinear path; and a unit located upstream of said transporting means for forming on said web means tufts of strands projecting from opposite faces thereof, said unit comprising a pair of needle holders respectively arranged to opposite sides of and substantially parallel to said path, a plurality of needles carried by each of said needle holders and projecting therefrom normal thereto toward the other needle holder and spaced from each other in longitudinal and transverse direction of said path and each having a free end constructed to displace during penetration of the needles into said web means strands of material of the web means in a direction transverse to the longitudinal direction of the latter, the needles carried by one of the needle holders being arranged between and symmetrically with respect to the needles carried by the other of said needle holders, a guide plate for each needle holder arranged between the latter and the web means substantially parallel thereto and each formed with openings therethrough through which the needles carried by the respective needle holder project, and with cavities extending from the surface facing the web means into the guide plate, said cavities extending substantially in the direction in which said web means is transported by said transporting means and being respectively aligned with the needles carried by the other needle plate for receiving the tufts produced during penetration of said needles into said web means, and moving means connected to said needle holders for simultaneously moving the same in opposite direction along an active and a return stroke.

7. An apparatus as defined in claim 6, wherein each of said guide plates is provided on the side thereof facing the web means with a plurality of ribs spaced from each other and extending in the direction the web means is transported by said transporting means, said ribs defining between themselves said cavities.

8. An apparatus as defined in claim 6, wherein said needle holders and said guide plates are exchangeable against other needle plates and guide plates with another spacing for the needles.

9. Apparatus as defined in claim 6, wherein said means for moving said needle holders along an active and a return stroke are constructed for adjusting the length of the strokes of each needle holder.

10. An apparatus as defined in claim 6, and including heating means downstream of said transporting means.

11. An apparatus as defined in claim 6, and including means for applying a chemical to said web means downstream of said transporting means.

12. An apparatus as defined in claim 6, and including means connecting said moving means for said needle holders to said web transporting means in such a manner that said web transporting means transport said web means in longitudinal direction for a distance at least substantially equal to a fraction of the spacing in longitudinal direction of said path of the needles on one of said needle holders, each time said needle holder moving means moves said needle holders along its return stroke.

* * * * *